United States Patent [19]

Grimm

[11] 3,961,729

[45] June 8, 1976

[54] SHAVING CREAM CAN HAVING BRUSH ATTACHMENT

[76] Inventor: William C. Grimm, 250 Woodlawn Ave., Jersey City, N.J. 07305

[22] Filed: Oct. 17, 1974

[21] Appl. No.: 515,554

[52] U.S. Cl. ..... 222/192; 15/160; 15/246; 132/80 R; 248/359

[51] Int. Cl.[2] ..... A46B 11/02; A46B 15/00

[58] Field of Search ..... 15/143 R, 246, 257.2, 15/258, 105; 132/80 R, 80 A, 80 B; 206/361; 220/85 D; 222/192; 248/110, 359, 360; 401/190

[56] References Cited

UNITED STATES PATENTS

| | | | |
|---|---|---|---|
| 67,787 | 8/1867 | Miles | 15/105.52 |
| 2,799,036 | 7/1957 | Scully | 248/359 X |
| 3,358,314 | 12/1967 | Matibag | 15/246 |
| 3,363,968 | 1/1968 | Williams | 401/190 |
| 3,536,285 | 10/1970 | Vaughn | 248/110 X |

FOREIGN PATENTS OR APPLICATIONS

| | | | |
|---|---|---|---|
| 852,410 | 9/1970 | Canada | 401/190 |
| 707,791 | 4/1931 | France | 132/80 R |
| 500,424 | 2/1939 | United Kingdom | 15/143 R |

*Primary Examiner*—Daniel Blum
*Attorney, Agent, or Firm*—V. Alexander Scher

[57] ABSTRACT

A shaving brush is carried upon the lower end of a holder. The holder has the shape of an elongated plate. Close to the upper end of the plate a transverse slot is provided upon its inner surface for attaching the plate to the projecting rim or edge of a can which is a dispenser of shaving cream. In the middle of the inner surface small projections are located which stabilize the attachment of the flat plate to the curved surface of the can. The brush is attached to the lower edge of the plate and spaced from the inner and outer surfaces of the plate.

1 Claim, 3 Drawing Figures

SHAVING CREAM CAN HAVING BRUSH ATTACHMENT

This invention relates to a shaving brush attachment, and refers more particularly to a shaving brush carrier adapted to be removably attached to a can containing shaving cream, such as a can of the aerosol type.

An object of the present invention is to provide a device which will produce a faster shave, will reduce the required number of razor rinses, will provide means applying lather evenly only to parts of the face to be shaved and will produce closer shaves by brushing lather into beard.

Other objects of the present invention will become apparent in the course of the following specification.

In accomplishing the objectives of the present invention, it was found desirable to provide a brush holder having the shape of an elongated plate. The brush extends from the lower edge of the plate and forms rows of bristles spaced from the outer and inner surfaces of the plate. Close to the upper edge of the plate, a transverse slot or groove is provided upon its inner surface. The purpose of the slot is to make it possible to attach the plate to the projecting rim or edge of a can which is a dispenser of shaving cream, such as a can of the aerosol type. Two spaced small projections or tits are located substantially in the middle of the inner surface of the plate. They stabilize the attachment of the flat plate to the curved surface of the can.

It is apparent that the brush holder of the present invention has the advantage that the brush and the lather can be stored and handled as a single item. The design of the brush makes possible an instant rinse and provides for the brushing of lather into the beard, so that closer shaves are produced.

The invention will appear more clearly from the following detailed description when taken in connection with the accompanying drawing, showing, by way of example only, a preferred embodiment of the inventive idea.

In the drawing:

FIG. 1 shows a can 10 of usual shape containing shaving cream, such as the can of the aerosol type. These cans are generally provided with a round projecting edge or rim 11.

According to the present invention, a brush carrier 12 is attached to this rim 11 by its slot 13. The brush carrier 12 has the shape of an elongated plate. The slot

Figure 1:
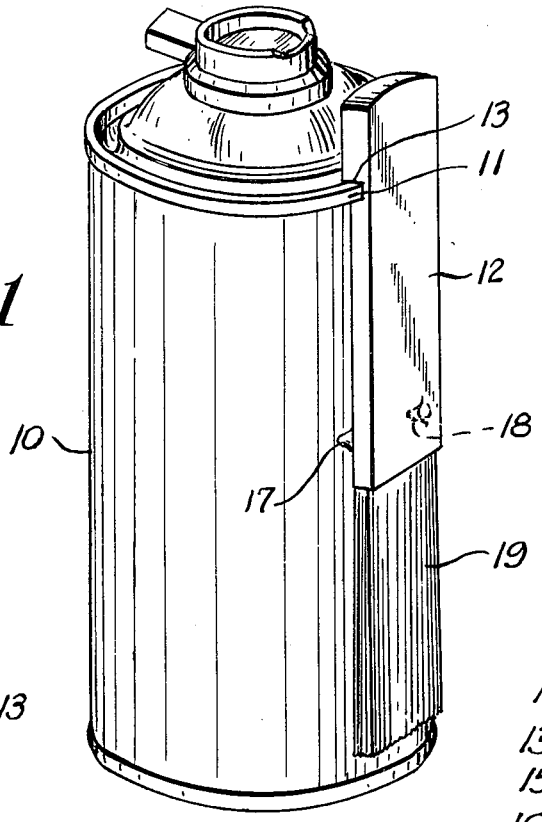
FIG. 1 is a side view of a shaving cream can carrying a brusher holder of the present invention.
Figure 2:
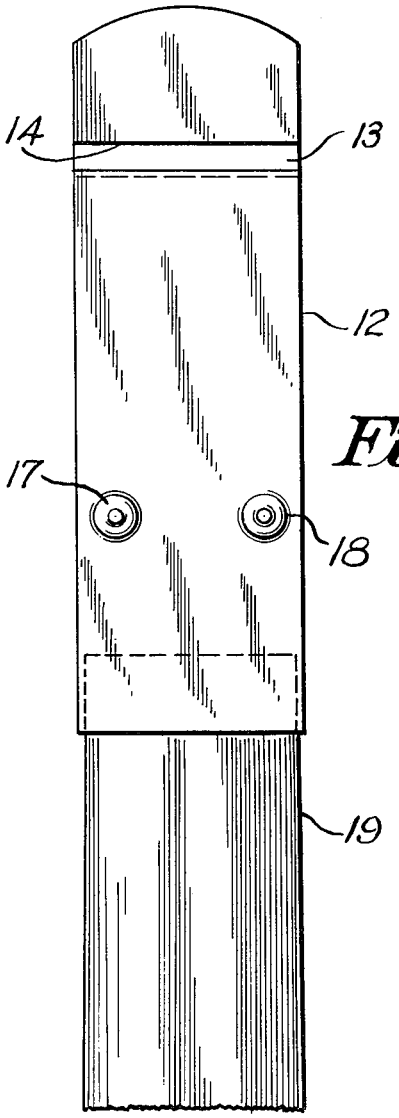
FIG. 2 shows the brush holder from its inner side.
Figure 3:
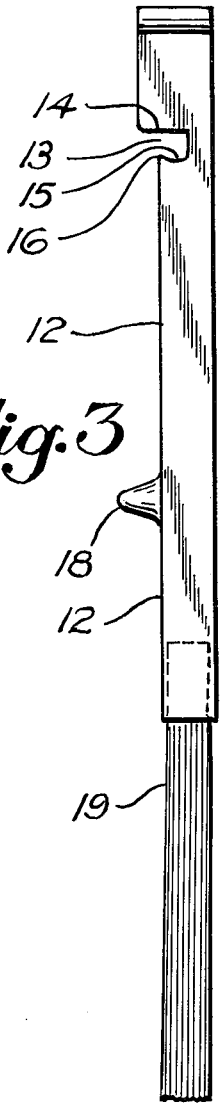
FIG. 3 is a side view of the brush holder.

13 extends across the entire inner surface of the plate close to its upper edge. As shown in FIG. 3, the upper portion 14 of the slot is somewhat greater than the lower portion 15, so that the part of the plate above the slot is somewhat thicker than the part below the slot. The lower portion 15 of the slot is curved.

It was found that this shape of the slot 13 is particularly effective in providing an attachment of the plate 12 to the can 10. The increased size of the upper portion 14 of the slot provides a better engagement with the rim 11. The curved shape of the lower portion 15 provides improved compressibility for a pressure fit.

In the illustrated embodiment, the plate 12 is flat, while the surface of the can 10 to which it is attached is obviously curved. To improve the attachment of the plate to the can, two small projections, so called tits 17 and 18, are provided upon the inner surface of the plate. These projections engage the curved surface of the can and thus stabilize the flat surface of the plate.

A brush 19 extends from the lower edge of the plate 12. The bristles of the brush are parallel and are fitted inside the plate at a distance from the outer and inner surfaces of the plate, as best shown in FIG. 3.

It is apparent that this arrangement provides means for applying the lather evenly only to parts of face to be shaved, that it reduces the number of razor rinses required to provide a faster shave, and that it makes possible the brushing of lather into the beard to produce a closer shave.

The brush attachment of the present invention makes it possible to store and handle two items, namely, the brush and the lather as a single unit.

I claim:

1. In combination with a can for shaving cream, said can having an upper round rim, a shaving bush attachment adapted to be carried by said can and comprising an elongated plate with upper and lower edges and inner and outer surfaces, said plate having a slot extending across the inner surface of the plate adjacent the upper edge thereof and having upper and lower surfaces, the upper surface of the slot extending to the inner surface of the plate by a greater length than that of the lower surface, the lower surface of the slot being curved, the upper and lower surfaces of the slot being spaced to fit over the rim of said can, a plurality of projections carried by said plate and extending from the inner surface of the plate to engage a surface of the can, and a brush carried by the lower edge of the plate and consisting of parallel bristles extending below the plate.

* * * * *